US006422753B1

(12) United States Patent
Thomas

(10) Patent No.: US 6,422,753 B1
(45) Date of Patent: Jul. 23, 2002

(54) SEPARABLE BEVERAGE RECEPTACLE PACKAGING WITH INTEGRAL DRINKING SPOUT

(76) Inventor: Peggy L. Thomas, 252 Golfwood Ave., Carneys Point, NJ (US) 08069

( * ) Notice: Subject to any disclaimer, the term of this patent is extended or adjusted under 35 U.S.C. 154(b) by 0 days.

(21) Appl. No.: 09/704,637

(22) Filed: Nov. 3, 2000

(51) Int. Cl.[7] ..... B65D 30/22

(52) U.S. Cl. ..... 383/209; 383/37; 383/39; 383/906

(58) Field of Search ..... 383/38, 39, 37, 383/209, 906

(56) References Cited

U.S. PATENT DOCUMENTS

| | | | | |
|---|---|---|---|---|
| 2,805,814 A | * | 9/1957 | Calasibetta et al. | 383/38 |
| 3,224,640 A | * | 12/1965 | Schneider et al. | 383/200 X |
| 3,490,576 A | * | 1/1970 | Alessi et al. | 206/749 |
| 3,935,810 A | * | 2/1976 | Milano | 99/467 |
| 4,433,783 A | * | 2/1984 | Dickinson | 383/38 X |
| 4,634,006 A | * | 1/1987 | Yanase | 383/91 X |
| 4,904,092 A | | 2/1990 | Campbell et al. | |
| 4,908,248 A | | 3/1990 | Nakashima et al. | |
| 4,972,657 A | | 11/1990 | McKee | |
| 5,041,317 A | | 8/1991 | Greyvenstein | |
| 5,118,202 A | | 6/1992 | Bruno | |
| 5,377,833 A | * | 1/1995 | Ranger | 383/38 X |
| 5,503,856 A | * | 4/1996 | Hustad et al. | 383/37 X |
| 5,881,869 A | * | 3/1999 | Hudson | 383/206 X |

* cited by examiner

*Primary Examiner*—Jes F. Pascua
(74) *Attorney, Agent, or Firm*—Henderson & Sturm LLP

(57) ABSTRACT

Separable beverage receptacle packaging 10 for potable and freezable liquids, as well as a method of fabricating the same wherein the packaging 10 comprises a plurality of individual beverage receptacle units 11 aligned in a side by side fashion relative to one another. Each beverage receptacle unit 11 has an interior fluid chamber 60 defined by a lower heat weld 40, an upper heat weld 42, and two vertical heat welds 41 that are formed on opposed sheets of plastic 20, 30 and wherein the heat welds 41 between the intermediate beverage receptacle units 11 are provided with perforated strips 45 and the upper end of each receptacle unit 11 is provided with an upper horizontal heat weld 42 disposed above a tapered crimp 70 having a gap 71 that defines an integral drinking spout 48 when the tear strip above the perforated line 49 is removed from the individual beverage receptacle units 11.

8 Claims, 2 Drawing Sheets

SEPARABLE BEVERAGE RECEPTACLE PACKAGING WITH INTEGRAL DRINKING SPOUT

BACKGROUND OF THE INVENTION

1. Field of the Invention

The present invention relates to the field of special receptacles or packaging in general, and in particular to a separable beverage receptacle package wherein a plurality of individual beverage receptacles are aligned in a side by side fashion and each individual receptacle has an integral spout exposed by the removal of a tear strip.

2. Description of Related Art

As can be seen by reference to the following U.S. Pat. Nos. 4,904,092; 4,908,248; 4,972,657; 5,041,317; and 5,118,202, the prior art is replete with myriad and diverse specialized receptacles designed to provide a wide variety of functions.

While all of the aforementioned prior art constructions are more than adequate for the basic purpose and function for which they have been specifically designed, they are uniformly deficient with respect to their failure to provide a simple, efficient, and practical packaging arrangement for beverages that will provide the user with easy access to flexible compartmented packaging that contains predetermined volumes of liquid arrayed in a side by side fashion.

As most adults are aware, children do not possess the proper amount of self control to regulate their fluid intake of a favorite beverage. In addition, there are many liquid beverages that maintain a more robust flavor when sealed within a container or receptacle prior to use.

As a consequence of the foregoing situation, there has existed a longstanding need for a new and improved type of beverage receptacle packaging that will maintain premeasured volumes of liquid beverages in a tear away side by side fashion, and the provision of such an arrangement is a stated objective of the present invention.

BRIEF SUMMARY OF THE INVENTION

Briefly stated, the separable beverage receptacle packaging that forms the basis of the present invention comprises in general, a plurality of receptacle units formed in a contiguous side by side fashion and including two sheets of plastic that are heat sealed along defined lines to create the individual receptacle units which are separated from one another by a line of scored perforations that allow the individual receptacle units to be physically separated from one another.

As will be explained in greater detail further on in the specification, the preferred embodiment of the invention is fabricated in accordance with a specific method which involves the steps of aligning the two sheets of plastic in a face to face orientation and using heat welds along the bottom of the sheets of plastic to define the base of each of the receptacle units.

Then, a series of elongated spaced vertical heat welds are created to define the opposed sides of each of the individual receptacle units. The heat welded seams initially terminate at a location spaced from the top of the opposed sheets to that the top of each receptacle unit is initially left open to accommodate a filling nozzle.

At this juncture, another horizontally disposed heat weld is applied across the open top of the individual receptacle units to captively entrain the liquid beverage and to join the opposed faces of that portion of the plastic sheets disposed above the liquid filled receptacle units.

Once this step has been completed, a tapered crimping step is applied below the top horizontally disposed heat weld to create a tear strip and an integrally formed drinking spout. The final steps in the method involve the cutting of a saw toothed pattern across the bottom edges of the plastic sheets and the perforation of the vertically aligned heat welds and the top of the tapered crimp area which facilitates the opening of the individual receptacle units, as well as the separation of the receptacle units from one another.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 4:
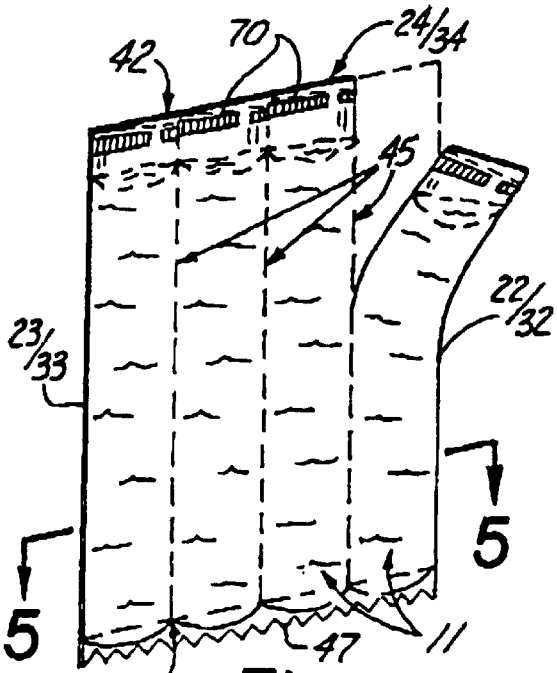
FIG. 4 is a perspective view of the finished product of this method.

As can be seen by reference to the drawings, and in particular to FIG. 4, the separable beverage receptacle packaging that forms the basis of the present invention is designated generally by the reference number 10 and includes a plurality of individual beverage receptacle units 11 which are aligned in a side by side detachable fashion relative to one another.

Figure 1:
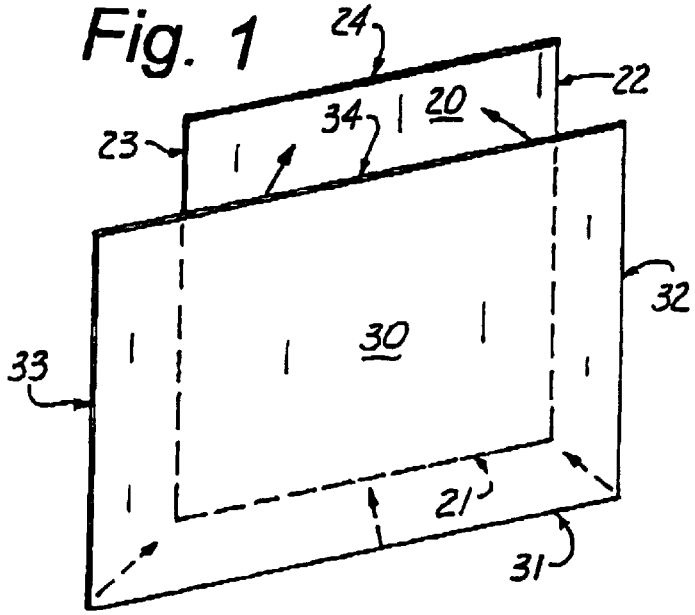
FIG. 1 is an exploded perspective view of the two sheets of plastic that are employed in the fabrication of this invention.
Figure 2:
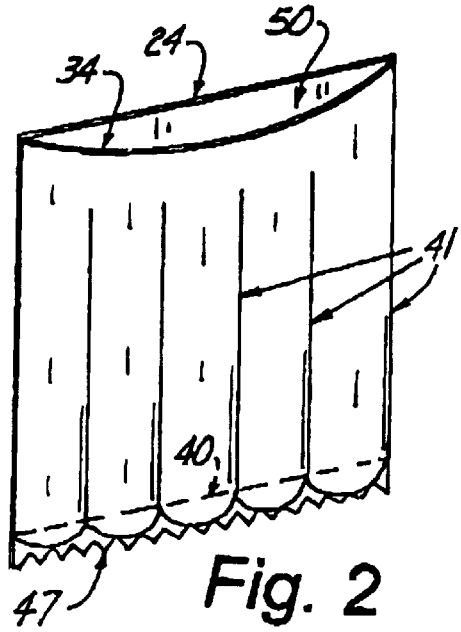
FIG. 2 is a perspective view of the first steps in the fabrication of the separable beverage receptacle packaging.
Figure 3:
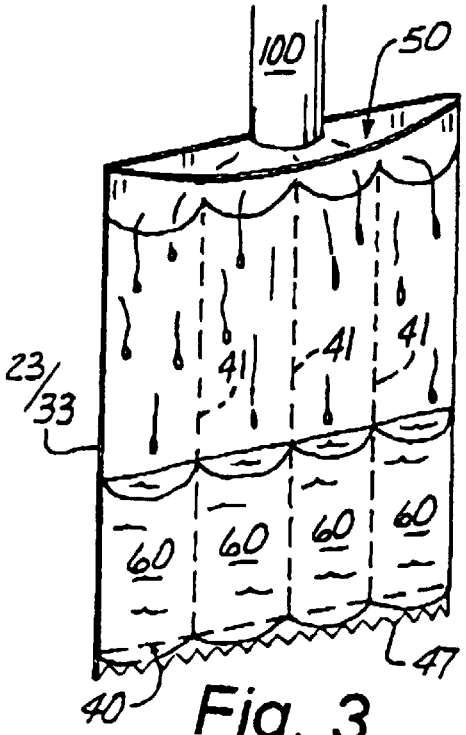
FIG. 3 is a perspective view showing the intermediate fabrication steps.
Figure 5:
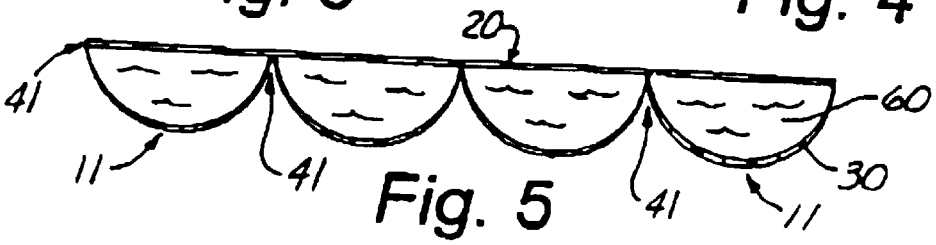
FIG. 5 is a cross sectional view taken through line 5—5 of FIG. 4.

As shown in FIGS. 1 and 2, the method of fabricating the finished packaging of FIG. 5 begins with the joining of two different sized sheets of material such as tin foil or plastic 20 and 30 having substantially different horizontal widths together in a proscribed fashion. The first sheet 20 comprises a backing sheet and the second sheet 30 comprises an enlarged elongated face sheet having a length that is approximately 50% longer that the length of the first sheet 20.

The first step in the process involves the joining of the bottom edges 21 and 31 of the plastic sheets 20 and 30, respectively, by a horizontal heat weld 40 shown in phantom in FIG. 2 and then joining the outer edges 22, 32 and 23, 33, as well as the intermediate portions of the backing sheet 20 and face sheet 30 with a series of horizontally spaced vertical heat welds 41 which extend from the bottom edges 21, 31 of each sheet to a location proximate to, but spaced from the upper edges 24, 34, respectively, of each of the plastic sheets to define an enlarged filler opening 50.

At this juncture, the first horizontal heat weld 40 and the plurality of vertical heat welds 41 define an interior fluid chamber 60 for each of the partially formed individual beverage receptacle units 11.

Turning now to FIG, 3, it can be seen that the next step in the process involves introducing a filler nozzle 100 into the enlarged opening 50 to fill the fluid chambers 60 with a selected volume of liquid such as water, juice, etc.

Once the fluid chambers 60 have been filled to a desired level, a second horizontal heat weld 42 is created between the two plastic sheets 20, 30 to encapsulate the fluid therein.

Figure 6:
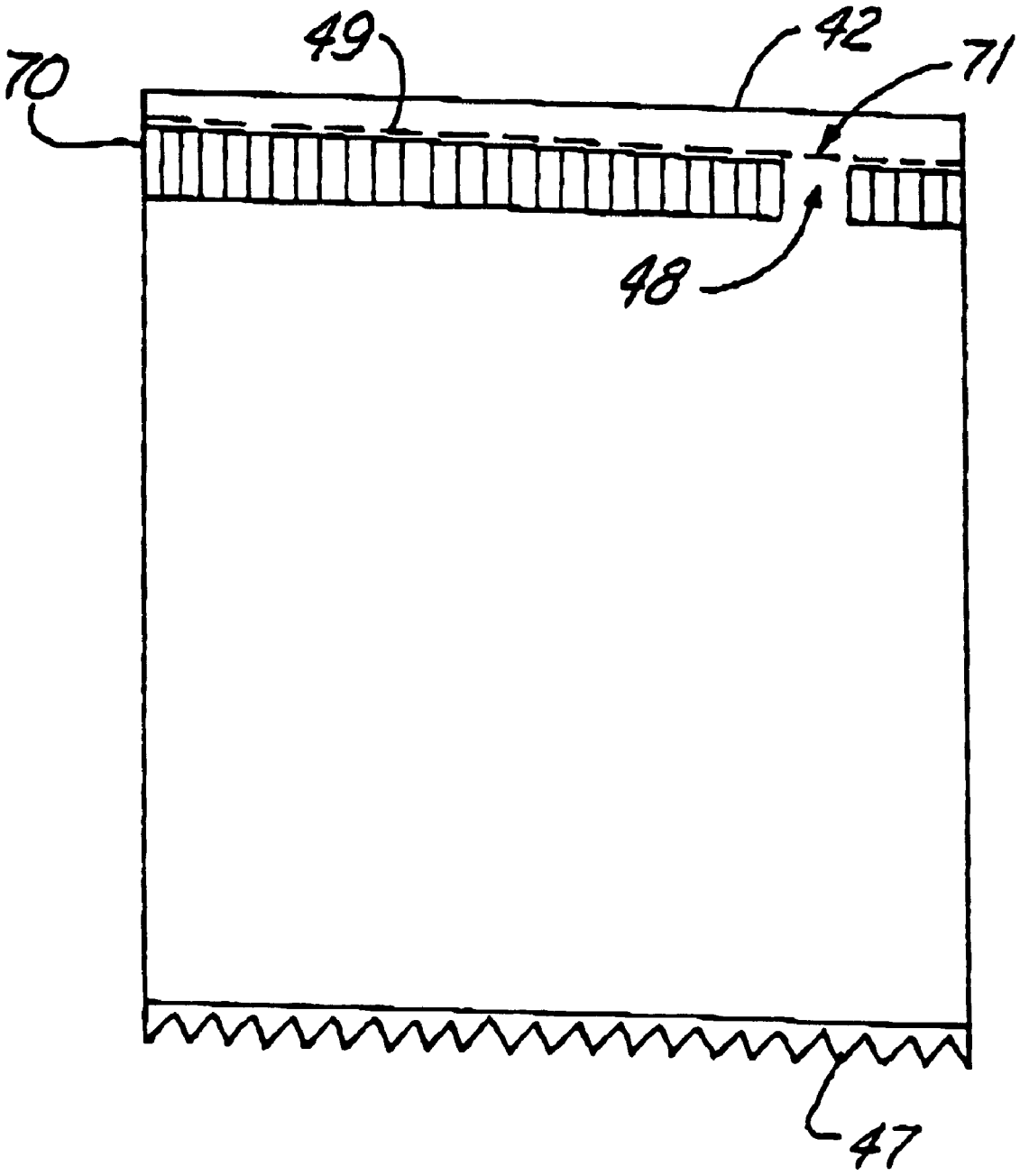
FIG. 6 is a front plan view of an individual receptacle formed in accordance with the teachings of this invention.

Turning now to FIG. 6, it can be seen that the next step in the process is the creation of a tapered crimp 70 that extends across the top of the joined sheets 20 and 30 below the heat weld 42; wherein, the tapered crimp 70 is interrupted as at 71 to form a drinking spout 48. At this juncture, the bottom edges 24, 34 of the sheets 20 and 30 are provided with a serrated edge 47.

In the final steps in the process, depicted in FIG. 4, the vertical heat welds 41 disposed between the outer edges 23, 33 and 22, 32 of the plastic sheets are provided with perforated lines 45 which extend from the lower heat weld 40 to the top heat weld 42 to allow for the separation of the individual beverage receptacles from one another.

In addition, as shown in FIG. 6, each individual beverage receptacle is provided with an angled perforated line 49 which runs the length of the beverage receptacle above the tapered crimp 70 so that the area above the perforated line 49 serves as a tear strip whose removal opens the top of the drinking spout 48 to provide access to the liquid contents of the individual beverage receptacles.

As can best be seen by reference to FIG. 5, given the fact that the backing sheet 20 has a shorter length than the face sheet 30 each of the individual receptacle units 11 will assume a generally semi circular configuration that adds to the functionality of the packaging in that in addition to employing the packaging to contain potable liquids the contents may also be frozen whereby the configuration of FIG. 5 will be readily conformable to a person's arms or legs as a cold compress.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. Separable beverage receptacle packaging for potable and freezable liquids comprising:

a plurality of individual beverage receptacle units formed from a backing sheet of material and a face sheet of material that are joined together at selected locations by a pair of vertically spaced horizontal heat welds and a first plurality of horizontally spaced vertical heat welds including a pair of outer edge vertical heat welds and a second plurality of intermediate vertical heat welds, and further including a plurality of perforated lines aligned along said second plurality of intermediate vertical heat welds; wherein, the both the backing sheet and face sheet have rectangular configurations wherein the length of the face sheet is approximately 50% longer than the length of the backing sheet.

2. The packaging of claim 1 wherein the top and bottom edges of the backing sheet and the face sheet are joined together.

3. The packaging of claim 2 wherein the pair of vertically spaced horizontal heat welds include a lower horizontal heat weld along the bottom edges of the backing sheet and the face sheet and an upper horizontal heat weld along the top edges of the backing sheet and face sheet.

4. The packaging as in claim 3 herein the bottom of the backing sheet and face sheet are provided with a serrated edge.

5. The packaging as in claim 4 wherein each of the receptacle units are adapted to form a generally semi circular cross sectional configuration when the backing sheet rests upon a planar surface.

6. The packaging as in claim 3; wherein, a tapered crimp is formed below the upper horizontal heat weld.

7. The packaging as in claim 6; wherein, the tapered crimp is provided with a gap that forms an integral drinking spout.

8. The packaging as in claim 7; wherein, the tapered crimp has a top edge that is provided with a perforated line that defines the bottom edge of a tear strip.

* * * * *